US009399303B2

(12) United States Patent
Conforti

(10) Patent No.: US 9,399,303 B2
(45) Date of Patent: Jul. 26, 2016

(54) HAIR TRIMMER WITH CURVED BLADE

(71) Applicant: Rose Conforti, Lombard, IL (US)

(72) Inventor: Rose Conforti, Lombard, IL (US)

( * ) Notice: Subject to any disclaimer, the term of this patent is extended or adjusted under 35 U.S.C. 154(b) by 92 days.

(21) Appl. No.: 14/197,772

(22) Filed: Mar. 5, 2014

(65) Prior Publication Data

US 2014/0250696 A1 Sep. 11, 2014

Related U.S. Application Data

(60) Provisional application No. 61/775,271, filed on Mar. 8, 2013.

(51) Int. Cl.
*B26B 19/06* (2006.01)
*B26B 19/28* (2006.01)
*B26B 19/38* (2006.01)

(52) U.S. Cl.
CPC ..... *B26B 19/282* (2013.01); *B26B 19/06* (2013.01); *B26B 19/28* (2013.01); *B26B 19/3846* (2013.01)

(58) Field of Classification Search
CPC .... B26B 19/06; B26B 19/063; B26B 19/066; B26B 19/28; B26B 19/282; B26B 19/3846
See application file for complete search history.

(56) References Cited

U.S. PATENT DOCUMENTS 1,875,125 A * 8/1932 Oster ..... B26B 19/06 30/221
2,224,342 A * 12/1940 Forster ..... B26B 19/12 30/34.05
2012/0192436 A1* 8/2012 Toy ..... B26B 19/06 30/216

* cited by examiner

*Primary Examiner* — Stephen Choi
(74) *Attorney, Agent, or Firm* — McAndrews, Held & Malloy, Ltd.

(57) ABSTRACT

A trimmer includes a fixed blade and a moveable blade. The fixed blade may include a focal aperture comprising a focal point, a radial extension region extending in a radial direction away from the focal point of the focal aperture and including a primary plane, and an arcuate region extending in a dimension away from the primary plane of the radial extension region. The moveable blade may include a focal aperture comprising a focal point, a radial extension region extending in a radial direction away from the focal point of the focal aperture and including a primary plane, and an arcuate region extending in a dimension away from the primary plane of the radial extension region.

3 Claims, 6 Drawing Sheets

HAIR TRIMMER WITH CURVED BLADE

CROSS REFERENCE TO RELATED APPLICATIONS

This application claims the benefit of U.S. Provisional Patent Application No. 61/775,271 filed on Mar. 8, 2013, the entirety of which is incorporated by reference herein.

FEDERALLY SPONSORED RESEARCH OR DEVELOPMENT

[Not Applicable]

JOINT RESEARCH AGREEMENT

[Not Applicable]

SEQUENCE LISTING

[Not Applicable]

BACKGROUND

Generally, this application relates to hair trimmers. In particular, this application relates to a hair trimmer for making curved cuts.

When performing short-length haircuts (for example, a typical man's haircut), it may be important to cleanly cut the hair around the ear of the individual. The hair around the ear may include, for example, sideburns. It may be difficult, however, for a hair stylist to achieve a clean cut around the ear. This difficulty may arise because hair trimmers 10 may be straight-bladed, as shown in FIG. 1. Ears, however, tend to be curved. It may be relatively difficult to make an accurate arch around the ear with a straight-bladed trimmer 10.

When performing longer-length haircuts (for example, an angled bob), similar problems may be presented. It may be difficult to create an arch around the nape of the neck with a straight-bladed trimmer.

Additionally, making such curved cuts with a straight-bladed trimmer may cause strain on stylists' wrists.

SUMMARY

According to inventive techniques, a trimmer includes a fixed blade and a moveable blade.

The fixed blade may include a focal aperture comprising a focal point, a radial extension region extending in a radial direction away from the focal point of the focal aperture and including a primary plane, and an arcuate region extending in a dimension away from the primary plane of the radial extension region. The arcuate region may include a plurality of teeth. The radial extension region of the fixed blade and the arcuate region of the fixed blade may intersect at a line defined by a constant radius from the focal point of the aperture of the fixed blade. The fixed blade may include a plurality of mounting apertures. The fixed blade may be fastened to a housing through the plurality of apertures.

The moveable blade may include a focal aperture comprising a focal point, a radial extension region extending in a radial direction away from the focal point of the focal aperture and including a primary plane, and an arcuate region extending in a dimension away from the primary plane of the radial extension region. The arcuate region may include a plurality of teeth. The moveable blade may have a drive pin energy transfer portion that receives a drive pin from a hair trimmer body and translates a circular movement of the drive pin into an arcuate movement of the moveable blade, wherein the arcuate movement of the moveable blade is along the primary plane of the radial extension region. The moveable blade further may include an elongated member between the drive pin energy transfer portion and the radial extension region. The focal aperture of the moveable blade may be through the elongated member. The radial extension region of the moveable blade and the arcuate region of the moveable blade may intersect at a line defined by a constant radius from the focal point of the aperture of the moveable blade.

The trimmer may include a drive shaft that includes the drive pin. The trimmer may include a motor that drives the drive shaft. The trimmer may include a post mounted through the focal aperture of the fixed blade and the focal aperture of the moveable blade. The fixed blade and moveable blade may have tongue and groove mating elements.

Figure 1:
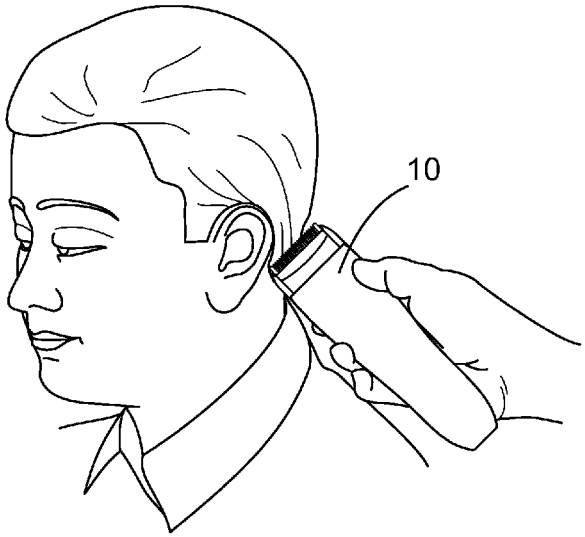
FIG. 1 (Prior Art)
FIG. 1 illustrates a hair trimmer according to the prior art.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

Described herein is a hair trimmer with curved blades. The curved blades allow a hair stylist to make a clean curve, for example, when cutting around an ear or forming an arch on a bob-style haircut.

Figure 2A:
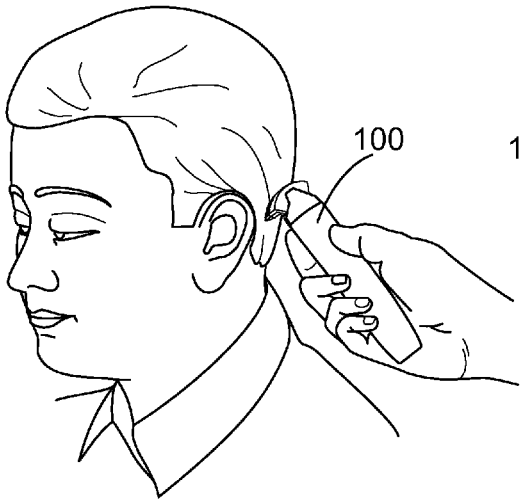
FIGS. 2A and 2B illustrate a hair trimmer, according to inventive techniques.
Figure 2B:
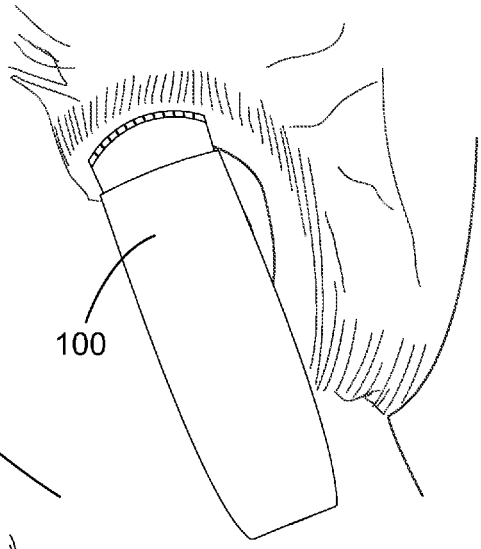
Figure 3A:
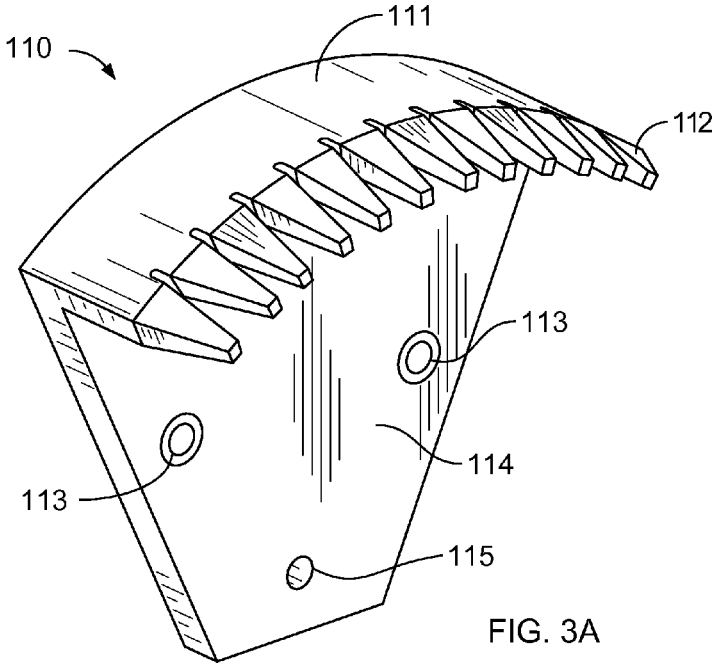
FIGS. 3A-3C illustrate perspective, front elevational, and cross-sectional views of a fixed blade of a hair trimmer, according to inventive techniques.
Figure 3B:
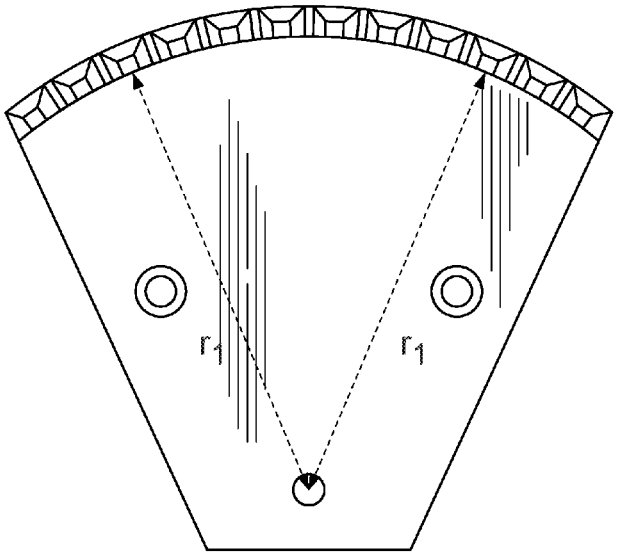
Figure 3C:
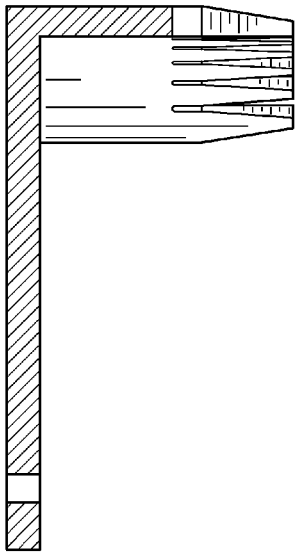
Figure 4A:
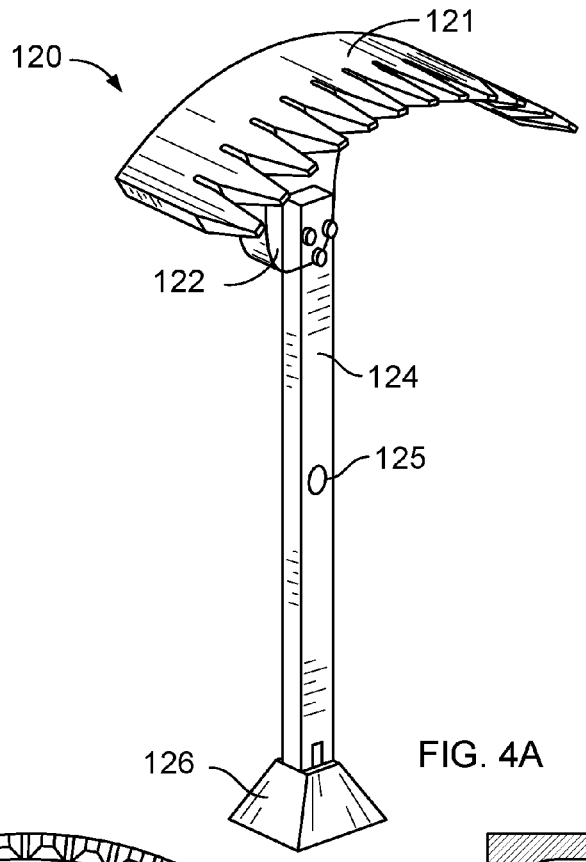
FIGS. 4A-4C illustrate perspective, front elevational, and cross-sectional views of a moveable blade of a hair trimmer, according to inventive techniques.
Figure 4B:
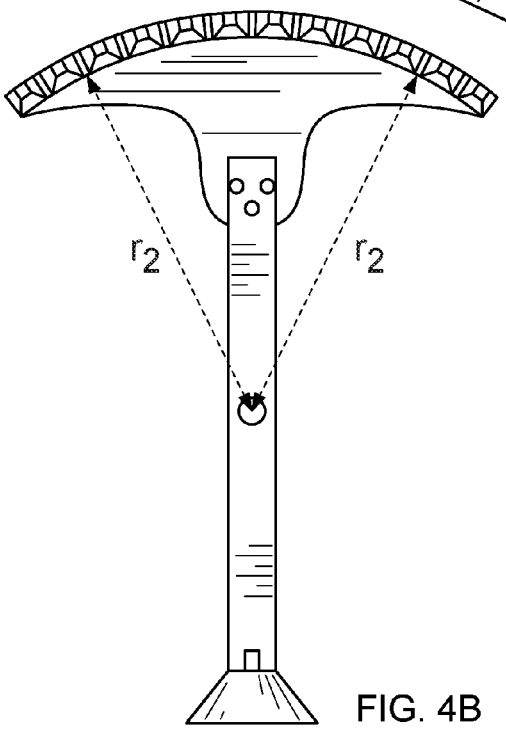
Figure 4C:
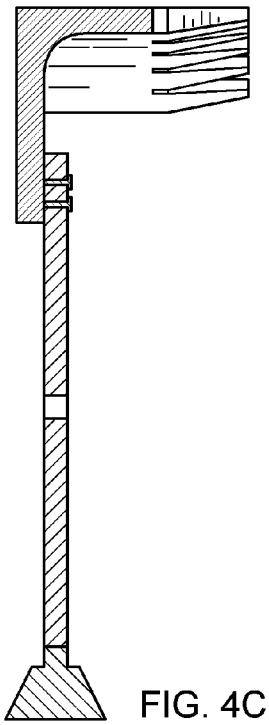

The trimmer 100 (see FIGS. 2A and 2B) may include a fixed blade 110 (see FIGS. 3A-3C) and a moveable blade 120 (see FIGS. 4A-4C). The fixed blade 110 may be an assembly of parts or a unitary part. The moveable blade 120 may be an assembly of parts or a unitary part.

The fixed blade 110 may include a radial extension region 114 including a focal aperture 115 and a plurality of mounting apertures 113. The mounting apertures 113 may accept fasteners (not shown) to fasten the fixed blade 110 to a housing (not shown). The radial extension 114 region may extend in a radial direction away from the focal point of the focal aperture 115. The fixed blade 110 may include a primary plane, defined generally by the radial extension region 114.

Figure 6A:
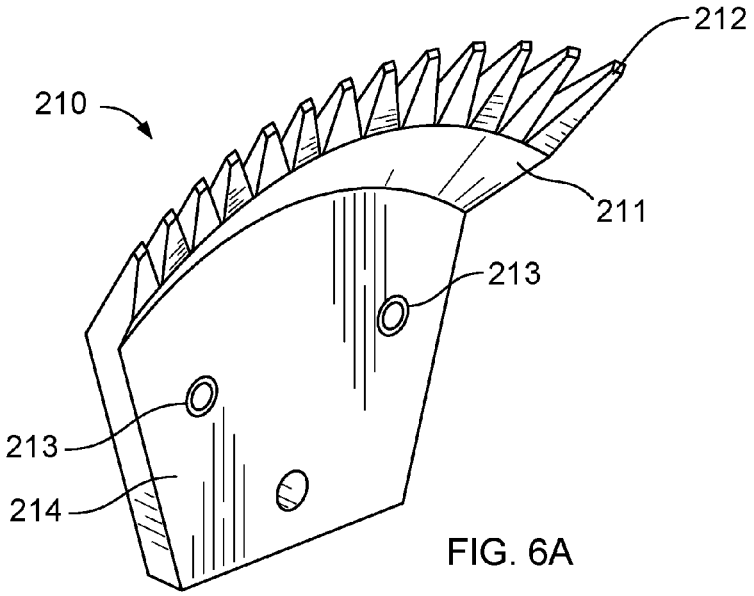
FIGS. 6A-6C illustrate perspective, front elevational, and cross-sectional views of a fixed blade of a hair trimmer, according to inventive techniques.
Figure 6B:
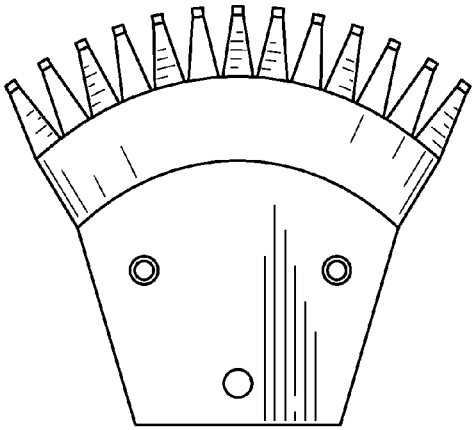
Figure 6C:
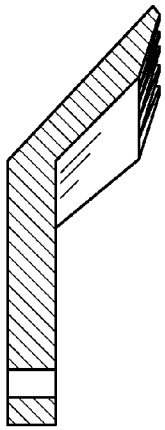

The fixed blade 110 may also include an arcuate region 111 including a plurality of teeth 112. The arcuate region 111 may extend in a dimension away from the primary plane of the radial extension region 114. As defined herein, a dimension extending away from the primary plane is not the exact same dimension as the primary plane. In other words, a dimension extending away from the primary plane is not a continuation of the dimension of the primary plane. For example, in FIGS. 3A-3C, the arcuate region 111 can be seen to extend in a dimension perpendicular to the primary plane of the radial extension region 114. The arcuate region 111 may extend away from the primary plane of the radial extension region 114 in a different direction or dimension. As another example, as shown in FIGS. 6A-6C, a similar fixed blade 210 has an arcuate region 211, teeth 212, mounting apertures 213, a focal aperture 214, and a radial extension region 214. As shown, the arcuate region 211 extends at approximately a 45 degree angle away from a primary plane of the radial extension region 214. The extension may be abrupt (e.g., forming a sharp right angle), as shown in FIGS. 3A-3C, or may occur more gradually (compare FIGS. 6A-6C showing a curved area with a more gradual extension).

In the fixed blade 120, the radial extension region 114 and the arcuate region 111 may intersect at a line defined by a constant radius (in the example of FIG. 3B, $r_1$) from the focal point of the focal aperture 115 of the fixed blade 110. The focal point of the focal aperture 115 may be at the center of the focal aperture 115.

The moveable blade 120 may include a radial extension region 122 and an arcuate region 121 including a plurality of teeth. The radial extension region 122 may extend in a radial direction away from the focal point of the focal aperture 125. The radial extension region 122 may define a primary plane. The radial extension region 122 may be connected with an elongated member through one or more connectors. The elongated member may include the focal aperture 125. The arcuate region 121 may extend in a dimension away from the primary plane of the radial extension region 122. For example, in FIGS. 4A-4C, the arcuate region 121 can be seen to extend in a dimension perpendicular to the primary plane of the radial extension region 122. Other options are also possible, such as a more gradual, non-perpendicular extension shown in FIG. 7.

The radial extension region 122 and the arcuate region 121 may intersect at a line defined by a constant radius (in the example of FIG. 4B, $r_2$) from the focal point of the focal aperture 125 of the moveable blade 120. A drive pin energy transfer portion 126 may receive a drive pin (for example, rotating in a circular motion in a first plane) and transfer the energy from the drive pin to the moveable blade 120 to create a rocking motion in a second plane (for example, the second plane is perpendicular to the first plane). Although not depicted, the arcuate region 121 may be mounted to and extend directly away from the elongated member 124. In such a configuration, no radial extension region may be present.

Figure 5A:
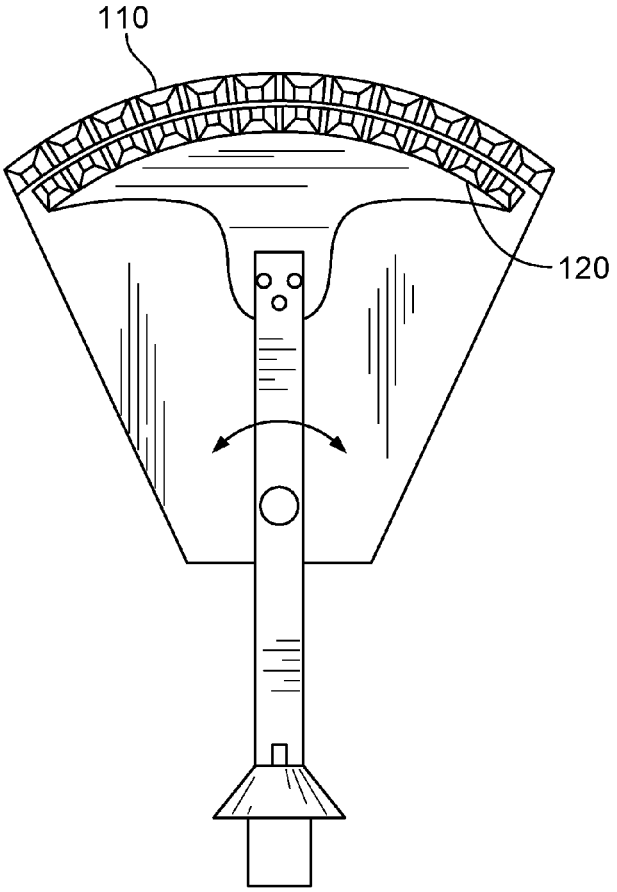
FIGS. 5A and 5B illustrate front elevational and cross-sectional views of a fixed blade and a moveable blade of a hair trimmer, according to inventive techniques.
Figure 5B:
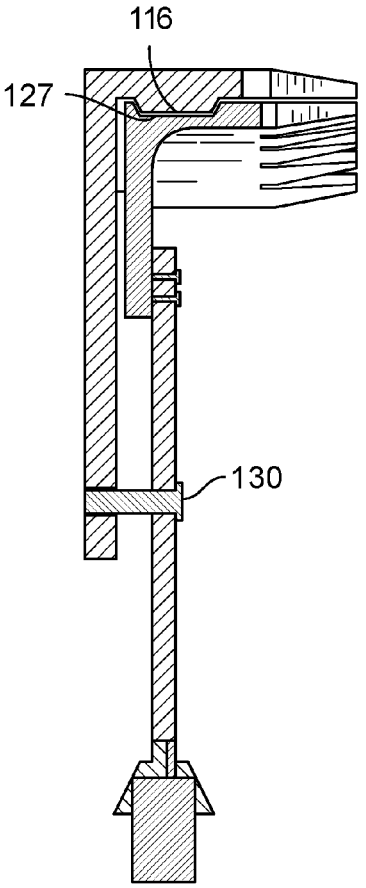

FIGS. 5A-5B depict the moveable blade 120 and the fixed blade 110 mounted through their focal apertures 125, 115 on a post 130. The fixed blade 110 may be fixed to a housing (not shown), or otherwise static in position. The moveable blade 120 may rock back and forth in a circular dimension. The teeth 112 of the fixed blade 110 and the teeth of the moveable blade 120 may be in proximity to each other. The rocking motion of the moveable blade 120 may create a scissors-type effect between the teeth so as to cut hair. The size and number of teeth on the moveable and fixed blades 120, 110 are depicted for illustrative purposes only. In practice, there may be more or less teeth and they may be longer or shorter. Although not illustrated, the teeth may also have sharpened portions. Also, the teeth may have different widths. For example, owing to the geometry of the overall system, the teeth of the movable blade 120 may be smaller in width than the teeth of the fixed blade 110. The front-to-back positioning of the moveable and fixed blades 120, 110 may be stabilized, for example, with a tongue 116 and groove 127 mating elements.

According to one technique, there may be no focal aperture on the fixed blade 110. For example, the radial extension region 112 of the fixed blade 110 may be relatively short. There may still be a focal point defined by the curvature of the arcuate region 111, albeit that such a focal point may not lie within the fixed blade 110, but rather off of the fixed blade. In such a case, the post 130 may extend through only the focal aperture 125 of the moveable blade. The post 130 may be attached on the other side directly to the housing or onto a portion mounted to the housing that is not the fixed blade. Furthermore, the post 130 may be integrated into either the fixed blade 110 or the moveable blade 120. In such cases, there may not be a focal aperture, but there would still be a focal point defined by the curvature of the arcuate region 111.

Figure 7:
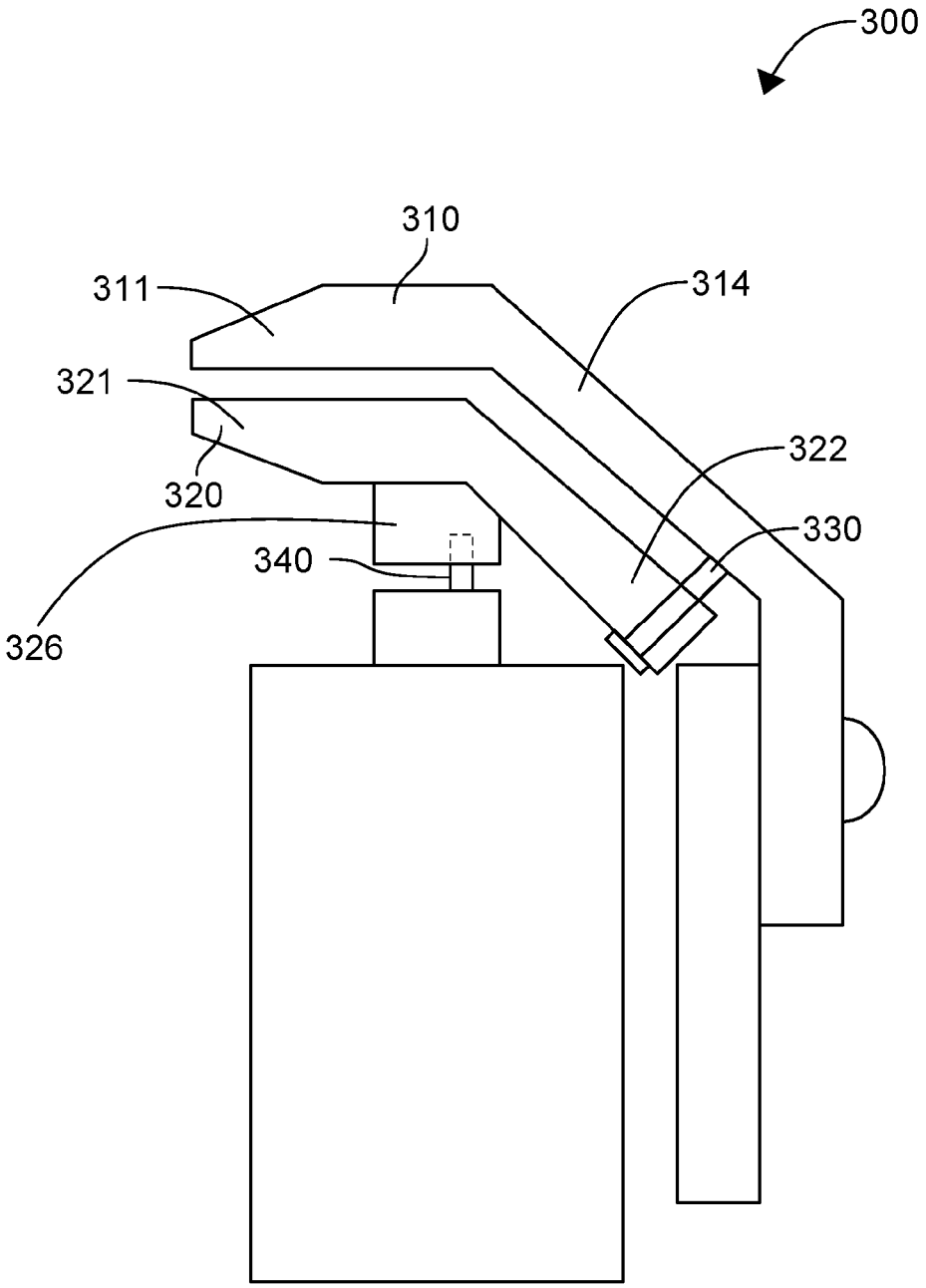
FIG. 7 illustrates a side cross-sectional view of a portion of a hair trimmer, according to inventive techniques.

FIG. 7 shows an alternate configuration for a trimmer 300. The trimmer 300 can include a fixed blade 310 (including an arcuate region 311 and a radial extension region 314), a moveable blade 320 (including an arcuate region, a radial extension region 322, and a drive pin energy transfer portion 326), a post 330, a drive pin 340, and a drive shaft. This configuration is intended to show that the arcuate regions 311, 321 of the blades 310, 320 can extend at a direction that is not at 90 degrees or perpendicular to the primary planes of the radial extension regions 314, 322. Also, the drive pin energy transfer portion 326 can be mounted on the arcuate region 321 of the moveable blade 320 (or formed as part of the arcuate region 321 of the moveable blade 320).

According to certain techniques, the fixed blade and the moveable blade may be part of a removable assembly or head unit. The removable assembly may be removably attachable to a trimmer base. For example, there may be a corresponding straight-blade assembly (see FIG. 1) that is also removably attachable to the same trimmer base. Such an arrangement may allow for inventive techniques described herein to be employed in interchangeable trimmer systems.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A hair trimmer comprising:

a fixed blade including:

a first focal aperture comprising a first focal point;

a first radial extension region extending in a radial direction away from the first focal point of the first focal aperture to define a first primary plane; and a first arcuate region including a first plurality of teeth, wherein the first arcuate region extends away from and in a first direction perpendicular to the first primary plane, wherein the first arcuate region further extends transversely to the first direction at a constant radius from the first focal point; and a moveable blade including:

an elongated member comprising a second focal aperture comprising a second focal point;

a second radial extension region connected to the elongated member and extending in a radial direction away from the second focal point of the second focal aperture to define a second primary plane; and a second arcuate region including a second plurality of teeth cooperating with the first plurality of teeth, wherein the second arcuate region extends away from and in a second direction perpendicular to the second primary plane, wherein the second arcuate region further extends transversely to the second direction at a constant radius from the second focal point;

a post passing through the first focal aperture and the second focal aperture, wherein the moveable blade operates in a reciprocating arcuate movement relative to the fixed blade about the post, wherein the reciprocating arcuate movement is guided by tongue and groove elements disposed on the fixed blade and the moveable blade, respectively; and wherein the elongated member is connected to a drive pin energy transfer portion configured to operate the moveable blade.

2. The trimmer of claim 1, wherein the drive pin energy transfer portion is configured to:

receive a drive pin to operate the moveable blade into the reciprocating arcuate movement along the first primary plane of the first radial extension region.

3. The trimmer of claim 1, wherein the fixed blade comprises a plurality of mounting apertures.

* * * * *